US011754248B2

(12) United States Patent
Bendix et al.

(10) Patent No.: US 11,754,248 B2
(45) Date of Patent: Sep. 12, 2023

(54) LENS, LENS SYSTEM, HEADLIGHT AND MOTOR VEHICLE

(71) Applicant: Hella GmbH & Co. KGaA, Lippstadt (DE)

(72) Inventors: Bernhard Bendix, Paderborn (DE); Matthias Knoche, Bad Westernkotten (DE); Alexander Musch, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/733,116

(22) Filed: Apr. 29, 2022

(65) Prior Publication Data

US 2022/0260225 A1 Aug. 18, 2022

Related U.S. Application Data

(63) Continuation of application No. PCT/EP2020/079539, filed on Oct. 21, 2020.

(30) Foreign Application Priority Data

Oct. 30, 2019 (DE) ..... 10 2019 129 254.9

(51) Int. Cl.
*F21S 41/29* (2018.01)
*F21S 41/20* (2018.01)

(52) U.S. Cl.
CPC ..... *F21S 41/29* (2018.01); *F21S 41/28* (2018.01)

(58) Field of Classification Search
CPC ..... F21S 41/29; F21S 41/28
See application file for complete search history.

(56) References Cited

U.S. PATENT DOCUMENTS 5,180,219 A * 1/1993 Geddie ..... F21S 41/28 362/546
5,321,594 A 6/1994 Hegemann et al.
2014/0301103 A1 10/2014 Colombo et al.

FOREIGN PATENT DOCUMENTS

CA 2472872 A1 6/2005
DE 7605088 U1 8/1977
DE 4227888 C1 12/1993
(Continued)

OTHER PUBLICATIONS

International Search Report dated Dec. 16, 2020 in corresponding application PCT/EP2020/079539.

*Primary Examiner* — Anne M Hines
(74) *Attorney, Agent, or Firm* — Muncy, Geissler, Olds & Lowe, P.C.

(57) ABSTRACT

A lens for a headlamp, the lens being at least partially formed from at least one plastic, having a lens surface and an edge surrounding the lens surface, from which at least one fastening element for fastening to a lens holder of the headlamp extends away from the lens surface, the at least one fastening element being designed as a fastening fork having two spaced-apart elastic fastening prongs. A lens system is also provided having a lens of this type and a lens holder, the lens holder having recesses corresponding to the fastening prongs, and the fastening prongs being elastically positioned by their outsides on outer insides of the recesses, or the fastening prongs being elastically positioned by their insides on inner insides of the recesses, so that the lens is fastened to the lens holder without play.

14 Claims, 5 Drawing Sheets

(56) References Cited

FOREIGN PATENT DOCUMENTS

| | | | |
|---|---|---|---|
| DE | 202010003680 | U1 | 7/2010 |
| DE | 102017103566 | A1 | 8/2018 |
| EP | 3366984 | A1 | 8/2018 |
| JP | S5887503 | A | 5/1983 |

* cited by examiner

LENS, LENS SYSTEM, HEADLIGHT AND MOTOR VEHICLE

This nonprovisional application is a continuation of International Application No. PCT/EP2020/079539, which was filed on Oct. 21, 2020, and which claims priority to German Patent Application No. 10 2019 129 254.9, which was filed in Germany on Oct. 30, 2019, and which are both herein incorporated by reference.

BACKGROUND OF THE INVENTION

Field of the Invention

The present invention relates to a lens for a headlamp, in particular a headlamp of a motor vehicle, a lens system including a lens of this type and a lens holder. The invention also relates to a headlamp and a motor vehicle.

Description of the Background Art

Glass lenses may be fastened to lens holders, for example, with the aid of a press fit. In the case of plastic lenses, however, an approach is known, for example, in which the lens is formed with welded tabs. The welded tabs may be laser-welded to the lens holder. This method is comparatively complex, due to the necessary laser welding. In addition, the lens may no longer be replaced without the lens holder in the event of a defect. Since the light/dark boundary of the light emitted from the lens is moved during a thermal expansion, for example, in a metallic lens holder, i.e., for example, during a cold start up to a warm operation of the headlamp, the lens holder should be manufactured from a plastic, for example from thermosetting plastic or an, in particular, fiber-reinforced thermoplastic. However, a welding of the plastic lens to the lens holder made from plastic is then no longer possible, A lens is known from JPS5887503A.

SUMMARY OF THE INVENTION

It is therefore an object of the present invention to provide an improved lens, which may be fastened to a lens holder cost-effectively, easily, detachably and without play.

Features and details which are disclosed in connection with the lens according to the invention also apply, of course, in connection with the lens system according to the invention, the headlamp according to the invention and the motor vehicle according to the invention and vice versa in each case, so that reference always is or may be made interchangeably with respect to the disclosure of the individual aspects of the invention.

According to an example of the invention, the object is achieved by a lens for a headlamp, the lens being at least partially formed from at least one plastic, having a lens surface and having an edge surrounding the lens surface, from which at least one fastening element for fastening to a lens holder of the headlamp extends away from the lens surface, the at least one fastening element being designed as a fastening fork have two spaced-apart elastic fastening prongs.

The lens may be fastened without play to a lens holder with the aid of the elastically formed and spaced-apart fastening prongs, in that the fastening prongs are inserted into recesses of a receptacle in the lens holder, where they are elastically positioned by their outsides on insides of the recesses. The fastening prongs may be cost-effectively provided on the lens. For example, they may be manufactured monolithically together with the lens or be molded on at a later time. The lens is very easily fastened to the lens holder by inserting it into the recesses and elastically positioning the fastening prongs on insides of the recesses.

The lens may also be referred to as a plastic lens. The lens may be formed, in particular, from the at least one plastic or from a single plastic. The lens holder may also be formed from a plastic. In particular, a thermosetting plastic and/or an, in particular, fiber-reinforced thermoplastic may be used as the plastic for the lens holder.

The two fastening prongs each can have an outside, the outsides facing away from each other, and the outsides adjoining a first circular segment having a first angle in an unloaded state of the two fastening prongs. In other words, the two fastening prongs or their outsides are positioned obliquely with respect to each other at the first angle. In particular, the fastening prongs or their outsides may be positioned such that they face each other obliquely with their ends. In the latter case, a center point of the circular segment is situated in the direction of a lengthening line for lengthening the fastening prongs. The first angle of the first circular segment may be reduced in size, in that the fastening prongs are pressed together on their outsides. The first angle of the first circular segment may also be increased in size, in that the fastening prongs are pressed apart on their outsides.

Accordingly, outer insides of recesses corresponding to the fastening prongs in the lens holder may adjoin a second circular segment having a second angle, the second angle being larger than the first angle, so that the fastening prongs may be inserted into the recesses. In a region, in particular on end-side halves of the fastening prongs, the outsides of the fastening prongs may be designed to be oversized with respect to the outer insides of the recesses. Alternatively, in a region, in particular on end-side halves of the fastening prongs, the insides of the fastening prongs may be designed to be undersized with respect to the inner insides of the recesses. In other words, the fastening prongs may have a greater distance or a lesser distance from each other in the region than the particular insides of the recesses. When the fastening prongs are inserted into the recesses, the fastening prongs are elastically deformed in the direction toward each other in the case of an oversize or in the direction away from each other in the case of an undersize, thus pressing against the outer insides of the recesses and being elastically positioned thereon or pressing against the inner insides of the recesses and being elastically positioned thereon. The lens may thus be fastened to the lens hold very securely, easily, detachably and with stability.

It is possible to design one of the fastening prongs to be more elastic than the other fastening prong, in that, for example, the one fastening prong is designed to be thicker than the other. This may achieve that one of the fastening prongs behaves in a relatively more elastic manner and ensures the fixing, while the other one is relatively more stable and stabilizes the fastening.

The fastening prongs can be designed to be tapered in the direction of their ends. The elasticity of the fastening prongs is increased thereby.

The lens can include at least two fastening forks, which are arranged opposite each other and/or obliquely with respect to each other. A secure fastening of the lens to the lens holder without play may be achieved thereby in multiple or all spatial directions. It may also be facilitated thereby that the thermal expansion of the lens forms concentrically around the optical axis of the lens.

The at least one fastening fork can be arranged in the middle of a length or a width of the lens. This optimizes the optical path through the lens.

At least one spring can have an engagement section is fastened to the lens. The spring may be designed as a so-called C spring. A C spring of this type has a curved shape. For example, it may be a metallic spring. The engagement section may engage behind a projection on the lens holder and thereby fix at least one further spatial direction.

The at least one spring can be fastened to the lens with the aid of a pivot joint. The spring may be rotated away from the lens with the aid of the pivot joint, so that, when inserting the fastening prongs into the recesses, it may be ensure that no hindrance by the spring occurs. After the fastening prongs are inserted into the recesses, the spring may be positioned on the lens holder or engage behind the projection with the aid of the engagement section for the purpose of ultimately fixing the lens on the lens holder.

The at least one spring can be arranged between the two fastening prongs. In particular, the pivot joint may be arranged between the fastening prongs. This facilitates a particularly compact design of the fastening and expands the clearance in the design of the lens and lens holder.

The object is also achieved by a lens system, which includes a lens according to the first aspect of the invention, and a lens holder, the lens holder having recesses corresponding to the fastening prongs, and the fastening prongs being elastically positioned by their outsides on outer insides of the recesses, or the fastening prongs being elastically positioned by their insides on inner insides of the recesses, so that the lens is fastened to the lens holder without play.

The recesses may have the shape of the fastening prongs. In particular, the fastening prongs may be designed to taper in the direction of their end sides. The recesses may furthermore be dimensioned to be larger or smaller than the fastening prongs in one region, in particular in an end-side half. In other words, the recesses here are designed to be oversized or undersized with respect to the fastening prongs. A simple insertion may be facilitated, and a play is avoided, since only the outsides of the fastening prongs are elastically positioned on the outer insides of the recesses, or only the insides of the fastening prongs are elastically positioned on the inner insides of the recesses, and the fastening prongs do not otherwise touch the recesses.

The outsides of the fastening prongs can be elastically positioned only in the region of an end-side half. A contact point or a contact surface of the fastening prongs, on which the outsides of the fastening prongs elastically adjoin the outer insides of the recesses, or the insides of the fastening prongs elastically adjoin the inner insides of the recesses, may move and retain the zero play upon introduction of a transverse force into the lens or the lens holder. The fastening prongs demonstrate a progressive spring behavior.

A stabilizing section can be formed between the fastening prongs, and a supporting section can be formed between the recesses, the stabilizing section being supported on the supporting section. The stabilizing section may be formed opposite the lens as an elevation. The supporting section may also be formed opposite the lens as an elevation. A support of the lens on the lens holder is provided thereby, which maintains a defined distance between the lens and the lens holder and does not impair the zero play.

A first fastening fork of the at least one fastening fork can fix the lens on the lens holder in a longitudinal direction along a longitudinal axis of the lens, and a second fastening fork of the at least one fastening fork can fix the lens on the lens holder in a width direction along a width axis of the lens. A secure fastening of the lens to the lens holder without play may be achieved thereby in two spatial directions situated perpendicularly to each other.

The two second fastening forks of the at least one fastening fork, which fix the lens on the lens holder in the width direction of the lens, can be arranged opposite each other. An exact positioning of the lens in relation to the lens holder is achieved thereby in the width direction and the longitudinal direction.

At least one spring may furthermore be arranged on the lens, which is formed with an engagement section. The engagement section may engage behind a projection on the lens holder. The lens may be fixed thereby in a further spatial direction, namely in the depth direction of the lens or the lens holder.

According to a further aspect of the invention, the object is also achieved by a headlamp, which includes a lens system according to the second aspect of the invention, the headlamp including a light unit, which is arranged to shine light through the lens.

The light unit may be any light-generating unit, for example an LED, a halogen lamp, an incandescent lamp or the like. The light unit is arranged accordingly behind the lens. The lens holder may be manufactured separately and be fastened to a mounting frame of the headlamp. Alternatively, the lens holder may be manufactured monolithically with the mounting frame. The light unit may be fastened, for example, to the lens holder or the mounting frame.

According to a further aspect of the invention, the object is also achieved by a motor vehicle, which includes at least one headlamp according to the third aspect of the invention. The headlamp may be, for example, a forward headlamp or a reversing headlamp.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
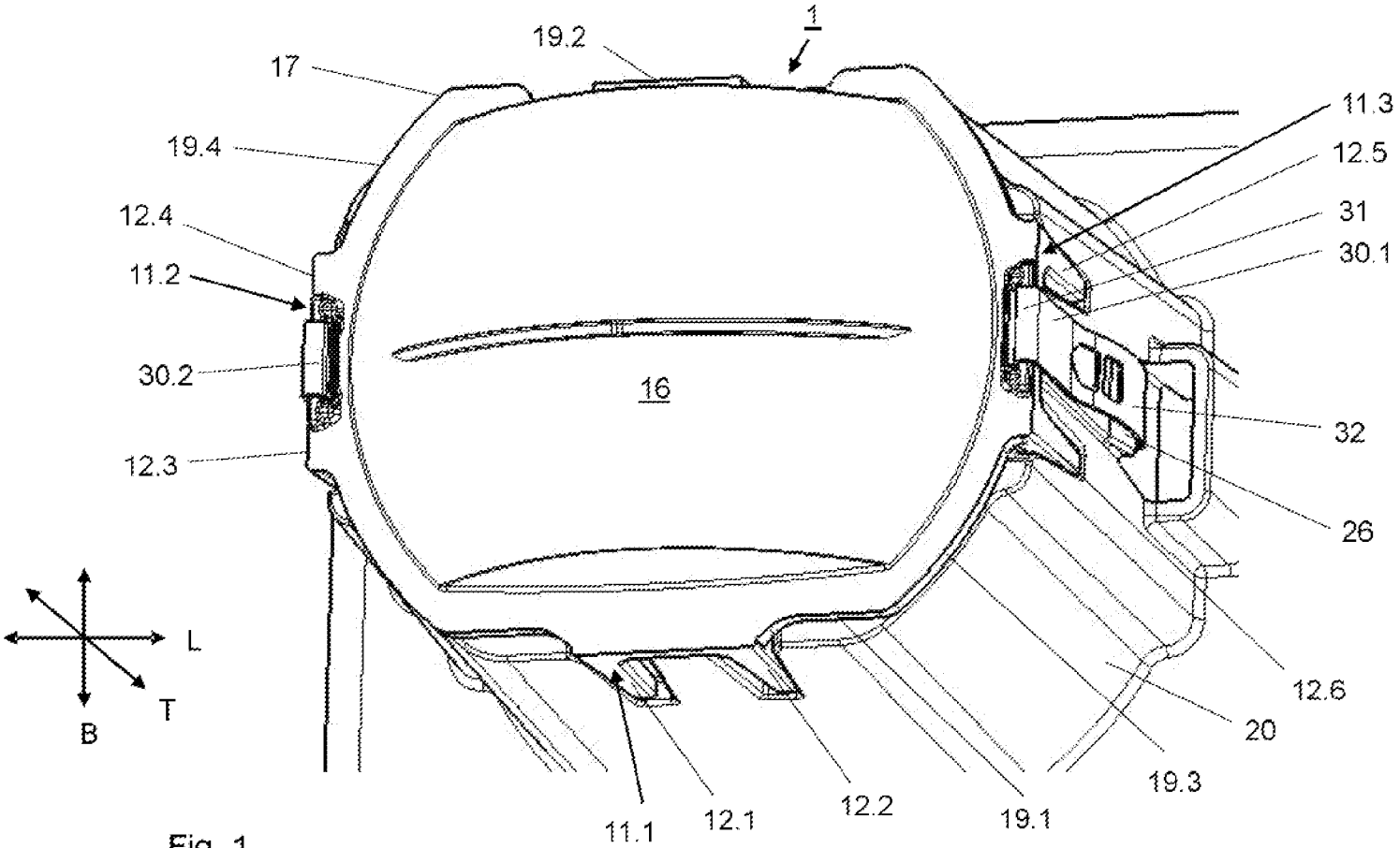
FIG. 1 shows a perspective side view of an exemplary embodiment of a lens system according to the invention.

FIG. 1 shows a perspective side view of an exemplary embodiment of a lens system 1 according to the invention. Lens system 1 includes a lens 10 and a lens holder 20, lens 10 being fastened to lens holder 20 with the aid of three fastening elements 11.1, 11.2, 11.3, which are designed as fastening forks 11.1, 11.2, 11.3, and two springs 30.1, 30.2.

Lens 10 has a lens surface 16 and an edge 17, which surrounds lens surface 16 and delimits lens 10. Fastening forks 11.1, 11.2, 11.3 extend from edge 17 perpendicularly or essentially perpendicularly away from lens surface 16. The extension follows along a depth axis T in a depth direction, which follows the thickness of lens 10 and the depth of lens holder 20.

A first fastening fork 11.1 of the three fastening forks 11.1, 11.2, 11.3 is situated on a lower length side 19.1 of lens 10 or of edge 17. First fastening fork 11.1 is arranged in the middle of a length of lens 10. The length is a largest extension of lens 10 in the longitudinal direction along longitudinal axis L, which is perpendicular to depth axis T. Lens 10 of the present exemplary embodiment has four sides 19.1, 19.2, 19.3, 19.4, two of which are opposite each other in each case. In the present case, these are two length sides 19.1, 19.2 and two width sides 19.3, 19.4. Length sides 19.1, 19.2 are longer than width sides 19.3, 19.4. Alternatively. however, length sides 19.1, 19.2 may also be the same length as width sides 19.3, 19.4. Width sides 19.3, 19.4 of lens 10 extend in the width directly along width axis B, which is perpendicular to longitudinal axis L and depth axis T. Length sides 19.1, 19.2 are straight in the present case, while width sides 19.3, 19.4 have a rounded shape.

A second fastening fork 11.2 and a third fastening fork 11.3 of the three fastening forks 11.1, 11.2, 11.3 are situated on width sides 19.3, 19.4 of lens 10 opposite each other. Second fastening fork 11.2 and third fastening fork 11.3 are thus opposite each other. In addition, second fastening fork 11.2 and third fastening fork 11.3 are arranged in the middle of their length along their width sides 19.3, 19.4. First fastening fork 11.1 is arranged obliquely with respect to second fastening fork 11.2 and third fastening fork 11.3.

Each of fastening forks 11.1, 11.2, 11.3 includes two spaced-apart elastic fastening prongs 12.1, 12.2, 12.3, 12.4, 12.5, 12.6. In other words, two of fastening prongs 12.1, 12.2, 12.3, 12.4, 12.5, 12.6 in each case are adjacent to each other and form fastening forks 11.1, 11.2, 11.3. Spaced-apart and adjacent fastening prongs 12.1, 12.2, 12.3, 12.4, 12.5, 12.6 face each other with their insides 15.1, 15.2 (cf. FIG. 2). A distance thus results between spaced-apart fastening prongs 12.1, 12.2, 12.3, 12.4, 12.5, 12.6 in each case (cf. FIG. 2).

First fastening fork 11.1 or its fastening prongs 12.1, 12.2 fix(es) lens 10 on lens holder 20 in the longitudinal direction along longitudinal axis in recesses 22.1, 22.2 of lens holder 20 corresponding to fastening prongs 12.1, 12.2. The operating principle of the elastic fastening without play is described in detail later on with reference to FIGS. 2 through 4.

Second fastening fork 11.2 and third fastening fork 11.3 fix lens 10 on lens holder 20 in the width direction along width axis B. A spring 30.1, 30.2 is arranged in each case between spaced-apart fastening prongs 12.3, 12.4, 12.5, 12.6 of second fastening forks 11.2, 11.3 on lens 10 or edge 17. Springs 30.1, 30.2 are designed as C springs and are fastened to lens 10 or edge 17 with the aid of a pivot joint 31 in each case. For this purpose, lens 10 has rod-shaped sections, which are encompassed by a hinge of springs 30.1, 30.2. Springs 30.1, 30.2 are rotatable with the aid of pivot joints 31. By inserting fastening forks 11.1, 11.2, 11.3 into corresponding recesses 22 in lens holder 20, fastening prongs 12 are elastically positioned on outer insides 23 of recesses 22 (cf. FIG. 4), by means of which lens 10 is fixed on lens holder 20 in the width direction along width axis B and in the longitudinal direction along longitudinal axis L. Afterwards, springs 30.1, 30.2 may be rotated in the direction of lens holder 20 and engage behind a projection 26 on lens holder 20 with the aid of an engagement section 32 for the purpose of also fixing lens 10 on lens holder 20 in the depth direction along depth axis T. Engagement axis 32 is a curved end section of spring 30. In the present case, springs 30.1, 30.2 are provided with a metallic design to be particularly elastic.

Figure 2:
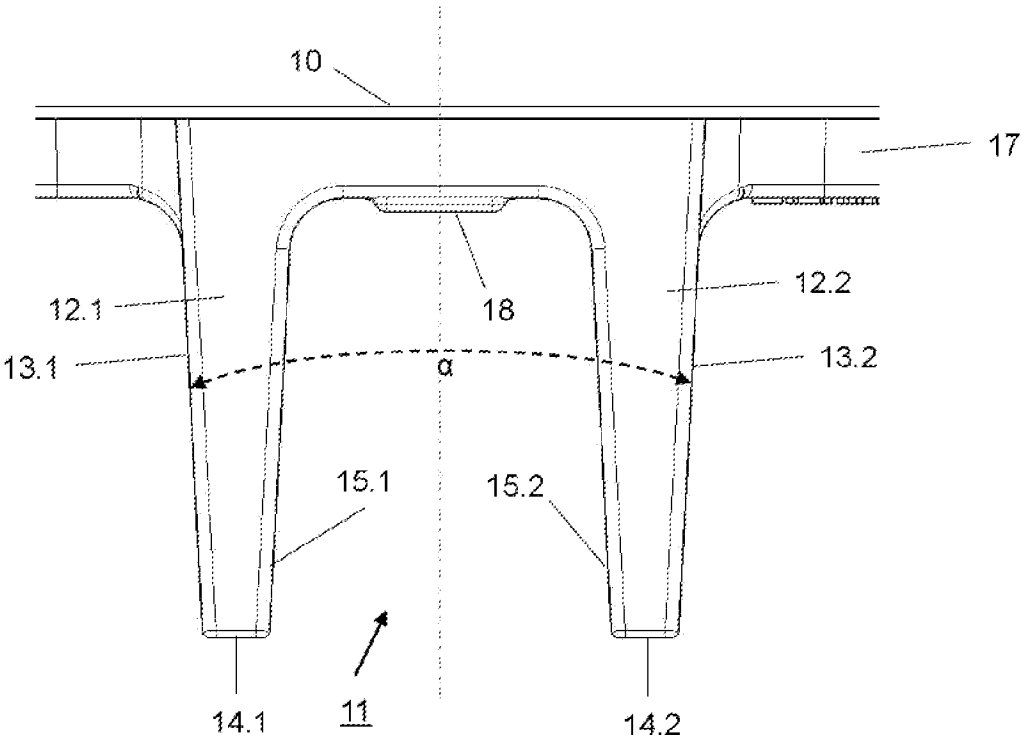
FIG. 2 shows a view of a fastening fork of a lens of the exemplary embodiment of the lens system from FIG. 1.

FIG. 2 shows a view of a fastening fork 11 of a lens 10 of the exemplary embodiment of lens system 1 from FIG. 1. Fastening fork 11, including its two fastening prongs 12.1, 12.2, extends perpendicularly away from edge 17 of lens 10. Fastening prongs 12.1, 12.2 are fastened to edge 17, spaced a distance apart. They have the same length. Fastening prongs 12.1, 12.2 taper toward their ends 14.1, 14.2, by means of which they are designed to be particularly elastic in an end region, in particular in the region of their end-side half.

Insides 15.1, 15.2 of fastening prongs 12.1, 12.2 face each other. Fastening prongs 12.1, 12.2 are situated at a distance from each other. Outsides 13.1, 13.2 of fastening prongs 12.1, 12.2, which face away from each other, limit a first circular segment having a first angle α. An unloaded state of fastening prongs 12.1, 12.2 is shown, in which first angle α is pronounced. Fastening prongs 12.1, 12.2 have a trapezoidal cross-section. Fastening prongs 12.1, 12.2 also have four sides. Alternatively, fastening prongs 12.1, 12.2 may have a triangular cross-section. Outsides 13.1, 13.2 and/or insides 15.1, 15.2 are furthermore straight or flat, so that they rest in the recesses over a wide area. Lens 10 also has a stabilizing section 18, which is designed as an elevation with respect to lens 10 or edge 17.

Figure 3:
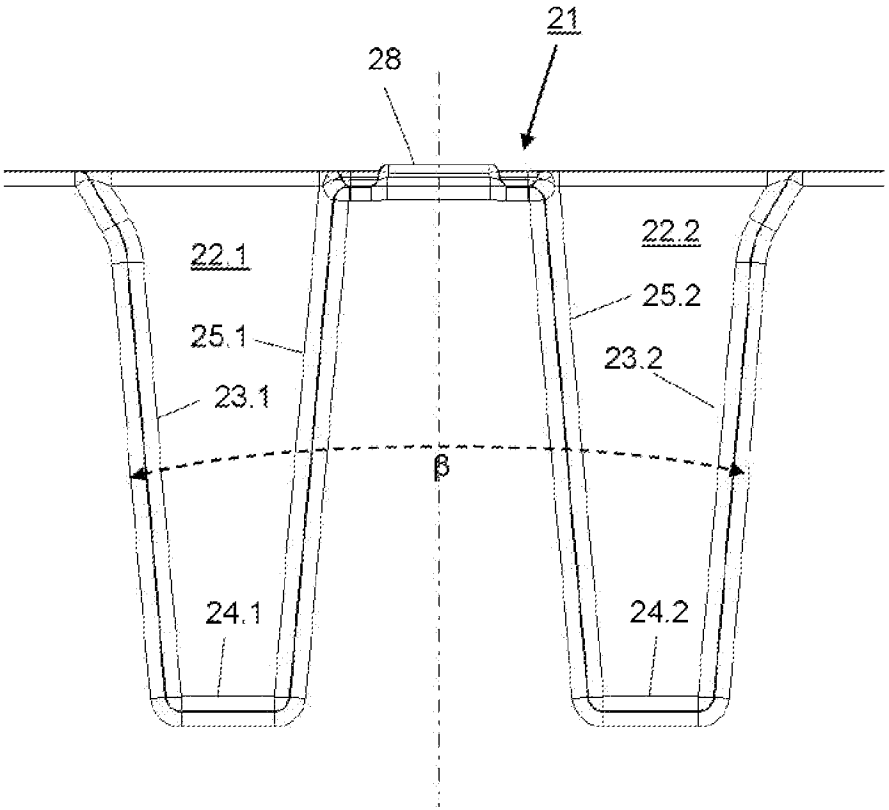
FIG. 3 shows a view of recesses in a lens holder of the exemplary embodiment of the lens system from FIG. 1.

FIG. 3 shows a view of recesses 22.1, 22.2 in a lens holder 20 of the exemplary embodiment of lens system 1 from FIG. 1. Recesses 22.1, 22.2 belong to a receptacle 21 for fastening fork 11. Recesses 22.1, 22.2 have end sides 24.1, 24.2 and inner insides 25.1, 25.2. Recess 21 or lens holder 20 also has a supporting system 28, which designed in a corresponding manner for the purpose of supporting stabilizing section 18. Recesses 22.1, 22.2 furthermore have insides 23.1, 23.2, which limit a second circular segment having a second angle ß. Second angle ß is larger than first angle α of the first circular segment for the purpose of facilitating an insertion of fastening prongs 12.1, 12.2.

Figure 4:
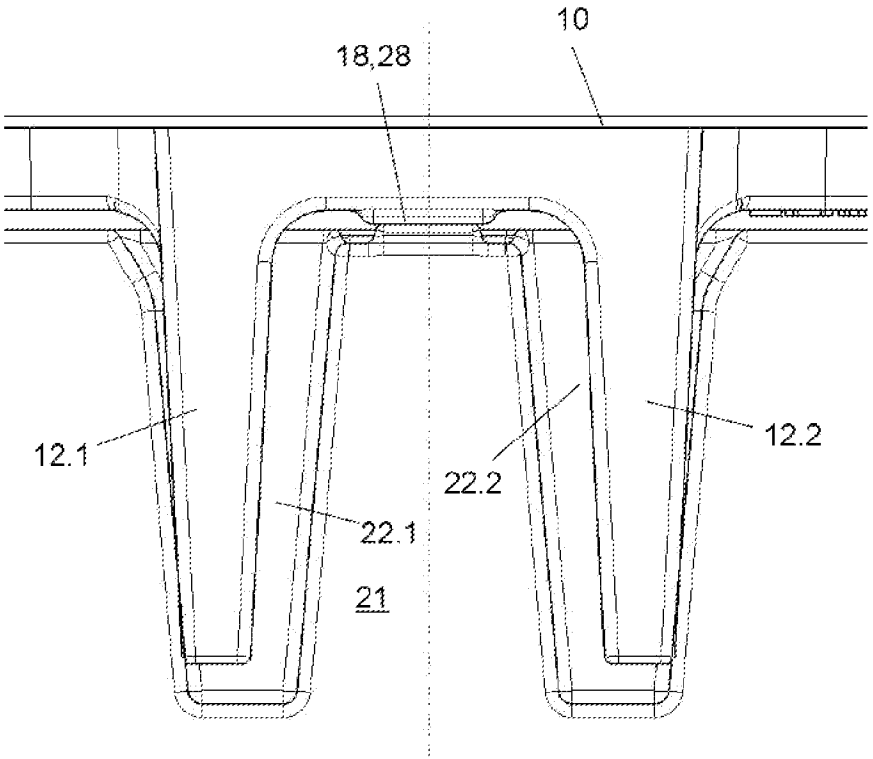
FIG. 4 shows a view of the fastening fork from FIG. 2 accommodated in the recesses shown in FIG. 3.

FIG. 4 shows a view of fastening fork 11 from FIG. 2 accommodated in recesses 22.1, 22.2 shown in FIG. 3. When fastening prongs 12.1, 12.2 are inserted into recesses 22.1, 22.2, fastening prongs 12.1, 12.2 are elastically deformed in the direction toward each other, thus pressing against outer insides 23.1, 23.2 and being elastically positioned thereon. For this purpose, fastening prongs 12.1, 12.2 are designed to be oversized in a region of an end-side half thereof, compared to outer insides 23.1, 23.2 of recesses 22.1, 22.2. To be precise, the distance between outsides 13.1, 13.2 of fastening prongs 12.1, 12.2 in this region is greater than the distance between outer insides 23.1, 23.2 of recesses 22.1, 22.2. This facilitates a very secure, easy, detachable and stable fastening of lens 10 on lens holder 20.

In an alternative specific embodiment, it is possible to design fastening prongs 12.1, 12.2 to be undersized with respect to inner insides 25.1, 25.2 in the region of the end-side half thereof. To be precise, the distance between insides 15.1, 15.2 would be less than the distance between inner insides 25.1, 25.2 of recesses 22.1, 22.2. When fastening prongs 12.1, 12.2 are inserted into recesses 22.1, 22.2, fastening prongs 12.1, 12.2 would be elastically deformed in the direction away from each other, thus pressing against inner insides 25.1, 25.2 and being elastically positioned thereon.

Figure 5:
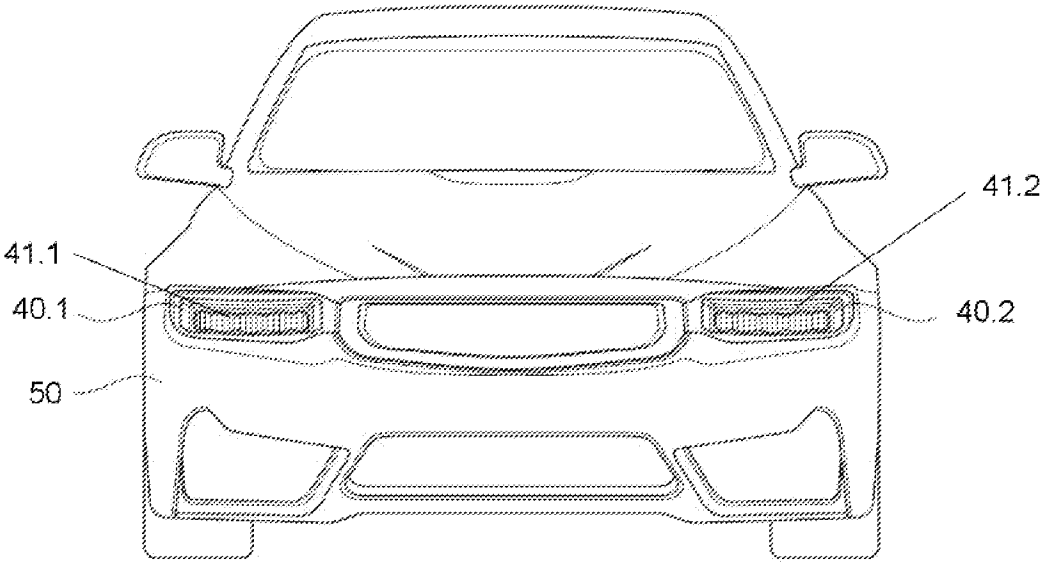
FIG. 5 shows a front view of an exemplary embodiment of a motor vehicle according to the invention.

FIG. 5 shows a front view of an exemplary embodiment of a motor vehicle 50 according to the invention. Motor vehicle 50 comprises two headlamps 40.1, 40.2 according to the invention, including light units 41.1, 41.2 as front headlamps, which have lens system 1 according to FIG. 1.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lens for a headlamp, the lens being at least partially formed from at least one plastic, the lens comprising:

a lens surface;

at least one fastening element for fastening to a lens holder of the headlamp; and an edge surrounding the lens surface, from which the at least one fastening element extends away from the lens surface, wherein the at least one fastening element is a fastening fork including two spaced-apart elastic fastening prongs, and wherein at least one spring having an engagement section is fastened to the lens.

2. The lens according to claim 1, wherein the two fastening prongs each have an outside, the outsides facing away from each other, and the outsides adjoining a first circular segment having a first angle in an unloaded state of the two fastening prongs, wherein the unloaded state is a state of the two fastening prongs before the at least one fastening element is fastened to the lens holder.

3. The lens according to claim 1, wherein the two fastening prongs are tapered in the direction of their ends.

4. The lens according to claim 1, wherein the lens includes at least two of the at least one fastening element, which are arranged opposite each other and/or obliquely with respect to each other.

5. The lens according to claim 1, wherein the at least one fastening element is arranged in the middle of a length or a width of the lens.

6. The lens according to claim 1, wherein the at least one spring is fastened to the lens with the aid of a pivot joint.

7. The lens according to claim 1, wherein the at least one spring is arranged between the two fastening prongs.

8. A lens system comprising:

the lens according to claim 1; and the lens holder, the lens holder having recesses corresponding to the two fastening prongs, wherein outsides of the two fastening prongs being elastically positioned on outer insides of the recesses or insides of the two fastening prongs being elastically positioned on inner insides of the recesses so that the lens is fastened to the lens holder without play.

9. The lens according to claim 8, wherein the outsides of the two fastening prongs are elastically positioned on the recesses only in a region of an end-side half.

10. The lens according to claim 8, wherein a stabilizing section is formed between the two fastening prongs, and a supporting section is formed between the recesses, the stabilizing section being supported on the supporting section.

11. The lens according to claim 8, wherein a first fastening element of the at least one fastening element fixes the lens on the lens holder in a longitudinal direction along a longitudinal axis of the lens, and a second fastening element of the at least one fastening element fixes the lens on the lens holder in a width direction along a width axis of the lens.

12. The lens according to claim 11, wherein two of the second fastening element are provided, which fix the lens on the lens holder in the width direction of the lens, Drenthe two second fastening elements being arranged opposite each other.

13. A headlamp comprising a lens system according to claim 8, the headlamp further comprising a light unit, which is arranged for shining light through the lens.

14. A motor vehicle comprising at least one headlamp according to claim 13.

* * * * *